US008494194B2

(12) United States Patent
Isozaki et al.

(10) Patent No.: US 8,494,194 B2
(45) Date of Patent: Jul. 23, 2013

(54) HEARING AID

(75) Inventors: Hiroyoshi Isozaki, Ehime (JP); Yasushi Ueda, Ehime (JP); Yasushi Imamura, Ehime (JP); Shigekiyo Fujii, Ehime (JP)

(73) Assignee: Panasonic Corporation, Osaka (JP)

( * ) Notice: Subject to any disclaimer, the term of this patent is extended or adjusted under 35 U.S.C. 154(b) by 80 days.

(21) Appl. No.: 13/188,690

(22) Filed: Jul. 22, 2011

(65) Prior Publication Data

US 2011/0274302 A1 Nov. 10, 2011

Related U.S. Application Data

(63) Continuation of application No. PCT/JP2009/005933, filed on Nov. 6, 2009.

(30) Foreign Application Priority Data

Feb. 6, 2009 (JP) ..... 2009-025743

(51) Int. Cl.
*H04R 25/00* (2006.01)

(52) U.S. Cl.
USPC ..... 381/312; 381/92

(58) Field of Classification Search
None
See application file for complete search history.

(56) References Cited

U.S. PATENT DOCUMENTS

| | | | | |
|---|---|---|---|---|
| 5,721,783 | A * | 2/1998 | Anderson | 381/328 |
| 6,272,229 | B1 | 8/2001 | Baekgaard | |
| 6,385,323 | B1 | 5/2002 | Zoels | |
| 6,879,692 | B2 * | 4/2005 | Nielsen et al. | 381/60 |
| 7,103,191 | B1 | 9/2006 | Killion | |
| 7,155,019 | B2 * | 12/2006 | Hou | 381/92 |
| 7,340,073 | B2 | 3/2008 | Fischer | |
| 2004/0202333 | A1 * | 10/2004 | Csermak et al. | 381/60 |
| 2006/0269080 | A1 | 11/2006 | Oxford et al. | |
| 2007/0009121 | A1 * | 1/2007 | Petersen | 381/312 |

FOREIGN PATENT DOCUMENTS

| | | |
|---|---|---|
| DE | 19849739 | 5/2000 |
| EP | 1 453 349 | 9/2004 |
| JP | 2003-506937 | 2/2003 |
| WO | 00/65873 | 11/2000 |
| WO | 01/10169 | 2/2001 |
| WO | 01/69968 | 9/2001 |

OTHER PUBLICATIONS

International Search Report of PCT Application No. PCT/JP2009/005933, dated Dec. 15, 2009.
The Extended European Search Report dated May 31, 2012 for the related European Patent Application No. EP 09 83 9599.

* cited by examiner

*Primary Examiner* — Duc Nguyen
*Assistant Examiner* — Taunya McCarty
(74) *Attorney, Agent, or Firm* — Panasonic Patent Center

(57) ABSTRACT

A hearing aid includes: first and second microphones; first and second A/D converters; a microphone sensitivity correction unit; a hearing assistance processing unit; a microphone sensitivity correction value calculation unit; a storage unit; a failure detection unit; a sound output unit; a D/A converter; and a receiver. The outputs of the first and second A/D converters are input to the microphone sensitivity correction value calculation unit. One output the microphone sensitivity correction value calculation unit is connected to the microphone sensitivity correction unit, and another output thereof is connected to the storage unit. An output of the storage unit and a signal output from the another output of the microphone sensitivity correction value calculation unit are input to the failure detection unit. Output signals of the failure detection unit and the hearing assistance processing unit are input to the sound output unit.

6 Claims, 8 Drawing Sheets

HEARING AID

CROSS-REFERENCE TO RELATED APPLICATIONS

This application is a continuation of International Application No. PCT/JP2009/005933, filed on Nov. 6, 2009, which claims priority from Japanese Patent Application No. 2009-025743 filed on Feb. 6, 2009, the disclosures of which Applications are incorporated herein by reference.

BACKGROUND

1. Technical Field

This invention relates to a technique of detecting a failure of a microphone of a hearing aid.

2. Description of Related Art

A hearing aid including two microphones for providing directivity for the user includes a correction circuit described below configured to eliminate an amplitude difference between output signals of the microphones so as to correct difference in sensitivity caused by the individual difference between the microphones (for example, see JP-A-2003-506937).

The correction circuit includes: a first microphone; a first ND converter connected on an output side of the first microphone; a second microphone; a second A/D converter connected on an output side of the second microphone; a microphone sensitivity correction unit connected on an output side of the second A/D converter; a hearing assistance processing unit to which an output of the microphone sensitivity correction unit and an output of the first A/D converter are input; a microphone sensitivity correction value calculation unit to which the output of the first A/D converter and an output of the second A/D converter are input, and one output of which is connected to the microphone sensitivity correction unit; a D/A converter connected on an output side of the hearing assistance processing unit; and a receiver connected to an output side of the D/A converter.

SUMMARY

The related art described above can provide directivity by using two microphones different in sensitivity. However, even when one microphone fails and amplitude of an output signal of the microphone lowers, the correction circuit operates so as to eliminate the output signal amplitude difference between the two microphones. Thus, the user can not recognize the failure of the microphone.

In view of the circumstances described above, an object of the invention is to provide a hearing aid that can make the user recognize a failure of a microphone.

In one aspect of the invention, a hearing aid includes: a first microphone; a first A/D converter connected on an output side of the first microphone; a second microphone; a second A/D converter connected on an output side of the second microphone; a microphone sensitivity correction unit connected on an output side of the second A/D converter; a hearing assistance processing unit to which an output of the microphone sensitivity correction unit and an output of the first A/D converter are input; a microphone sensitivity correction value calculation unit to which the output of the first A/D converter and an output of the second A/D converter are input, and one output of which is connected to the microphone sensitivity correction unit; a storage unit connected to another output of the microphone sensitivity correction value calculation unit; a failure detection unit to which an output of the storage unit and a signal output from the another output of the microphone sensitivity correction value calculation unit are input; a sound output unit to which an output signal of the failure detection unit and an output signal of the hearing assistance processing unit are input; a D/A converter connected on an output side of the sound output unit; and a receiver connected on an output side of the D/A converter.

DETAILED DESCRIPTION OF EXEMPLARY EMBODIMENTS

A hearing aid of the embodiment will be described below in detail with reference to the drawings.

Figure 1:
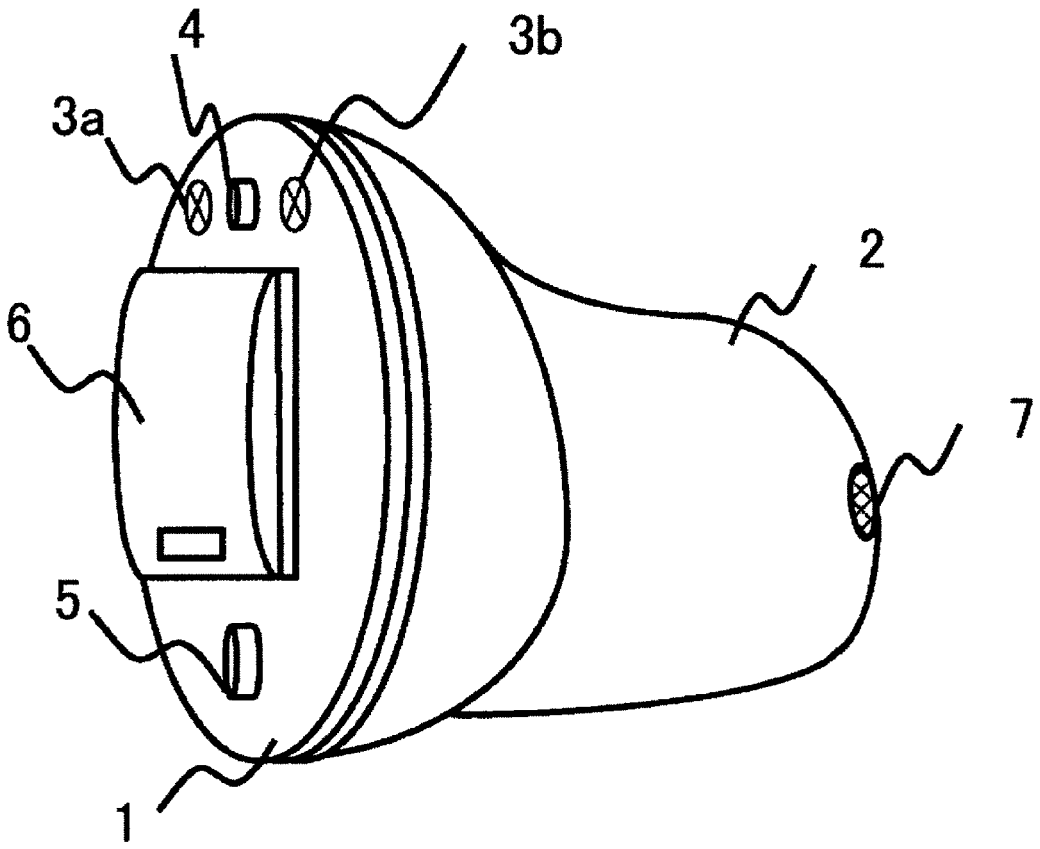
FIG. 1 is an external view of a hearing aid according to an embodiment of the invention.

As shown in an external view of FIG. 1, a hearing aid of the embodiment includes a face plate 1 and a shell 2 which are assembled. The face plate 1 is provided with a microphone 3*a* (first microphone), a microphone 3*b* (second microphone), a switch 4, a volume dial 5, and a battery insertion port 6. The shell 2 is provided with a receiver 7 at a position on the opposite side to the face plate 1.

Figure 2:
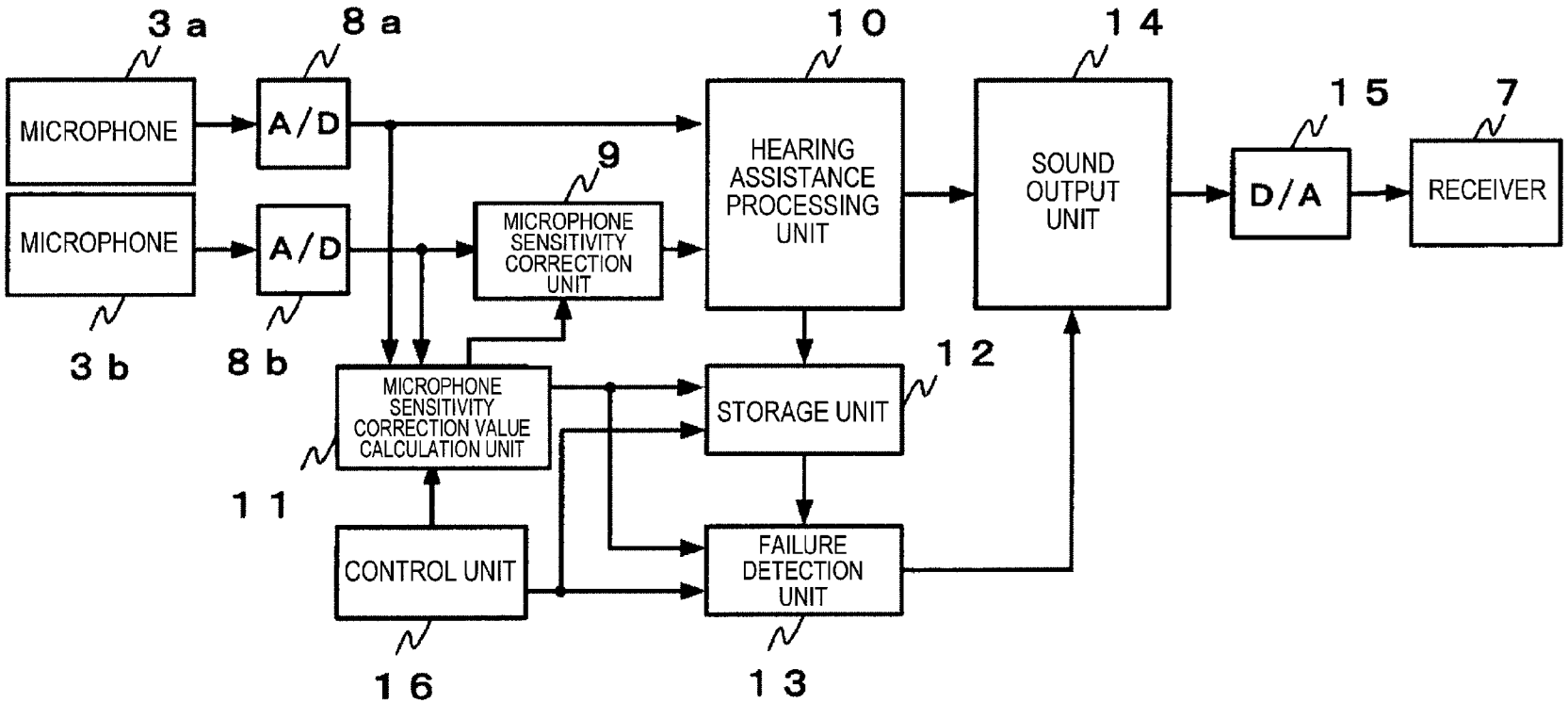
FIG. 2 is a block diagram of the hearing aid according to the embodiment of the invention.

FIG. 2 is an electrical diagram showing functional components provided in the shell 2. The microphone 3*a* and the microphone 3*b* shown in FIG. 1 are placed most upstream in the shell 2. In the shell 2, there is provided: an A/D (Analog to Digital) converter 8*a* (first A/D converter) connected on an output side of the microphone 3*a*; an A/D converter 8*b* (second A/D converter) connected on an output side of the microphone 3*b*; a microphone sensitivity correction unit 9 connected on an output side of the A/D converter 8*b*; a hearing assistance processing unit 10 to which an output of the microphone sensitivity correction unit 9 and an output of the A/D converter 8*a* are input; a microphone sensitivity correction value calculation unit 11 to which the output of the A/D converter 8*a* and an output of the A/D converter 8*b* are input, and one output of which is connected to the microphone sensitivity correction unit 9; a storage unit 12 connected to another output of the microphone sensitivity correction value calculation unit 11; a failure detection unit 13 to which an output of the storage unit 12 and a signal output from the another output of the microphone sensitivity correction value calculation unit 11 are input; a sound output unit 14 to which an output signal of the failure detection unit 13 and an output signal of the hearing assistance processing unit 10 are input; a D/A (Digital to Analog) converter 15 connected on an output side of the sound output unit 14; and the receiver 7 connected on an output side of the D/A converter 15. In addition, there is further provided: a control unit 16 configured to the microphone sensitivity correction value calculation unit 11, the storage unit 12, and the failure detection unit 13.

The microphone 3*a* and the microphone 3*b* are configured to collect surrounding sound of the hearing aid, convert the sound into electric signals, and output the signals to the A/D converter 8*a* and the A/D converter 8*b*, respectively, as an analog input signal. The microphones are placed on the face plate 1 at a given distance from each other as shown in FIG. 1. Usually, the microphones are distant from each other relatively front and rear such that one of the microphones is closer to the front direction of the user (face side) and the other thereof is closer to the back direction (head back side), and the microphones are called front microphone and rear microphone.

In the embodiment, the case where the microphone 3*a* is the front microphone and the microphone 3*b* is the rear microphone will be described as an example. In the embodiment, the microphone sensitivity correction unit 9 adjusts the amplitude of the output signal of the rear microphone thereby performing a sensitivity correction. The signal of the front microphone and the signal of the rear microphone which is subjected to sensitivity correction are processed so as to provide directivity for the user by a directivity control unit (not shown) provided in the hearing assistance processing unit 10.

The A/D converter 8*a* and the A/D converter 8*b* are configured to: sample analog input signals output by the microphone 3*a* and the microphone 3*b* at the periods of an operation clock configured to drive a digital circuit in the hearing aid; and output the signals as digital input signals which represent the amplitude of the analog input signals by multiple bits.

The microphone sensitivity correction unit 9 is configured to: correct the amplitude value of the digital input signal output by the A/D converter 8*b* by using the microphone sensitivity correction value output by the microphone sensitivity correction value calculation unit 11; and output the corrected amplitude value to the hearing assistance processing unit 10 as a digital correction input signal. That is, the hearing aid shown in the embodiment corrects the output signal of the microphone 3*b* (rear microphone) so as to perform a sensitivity correction such that the corrected signal has the same sensitivity as the output signal of the microphone 3*a* (front microphone). The microphone sensitivity correction value is a value to be multiplied by the digital input signal although described later in detail. Therefore, the microphone sensitivity correction unit 9 is implemented as a multiplier configured to multiply the amplitude value of the digital input signal by the microphone sensitivity correction value.

The digital input signal input from the A/D converter 8*a* and the digital correction input signal input from the microphone sensitivity correction unit 9 are input to the hearing assistance processing unit 10, and the hearing assistance processing unit 10 performs hearing assistance processing matched with the hearing characteristic of the user and outputs the process signal to the sound output unit 14 as a digital hearing assistance processing signal. The hearing assistance processing unit 10 performs processing for providing directivity described above and amplifies the signal matched with the hearing characteristic, etc., but these processes are similar to the processing of the related-art hearing aid and therefore will not be described again in detail.

Figure 3:
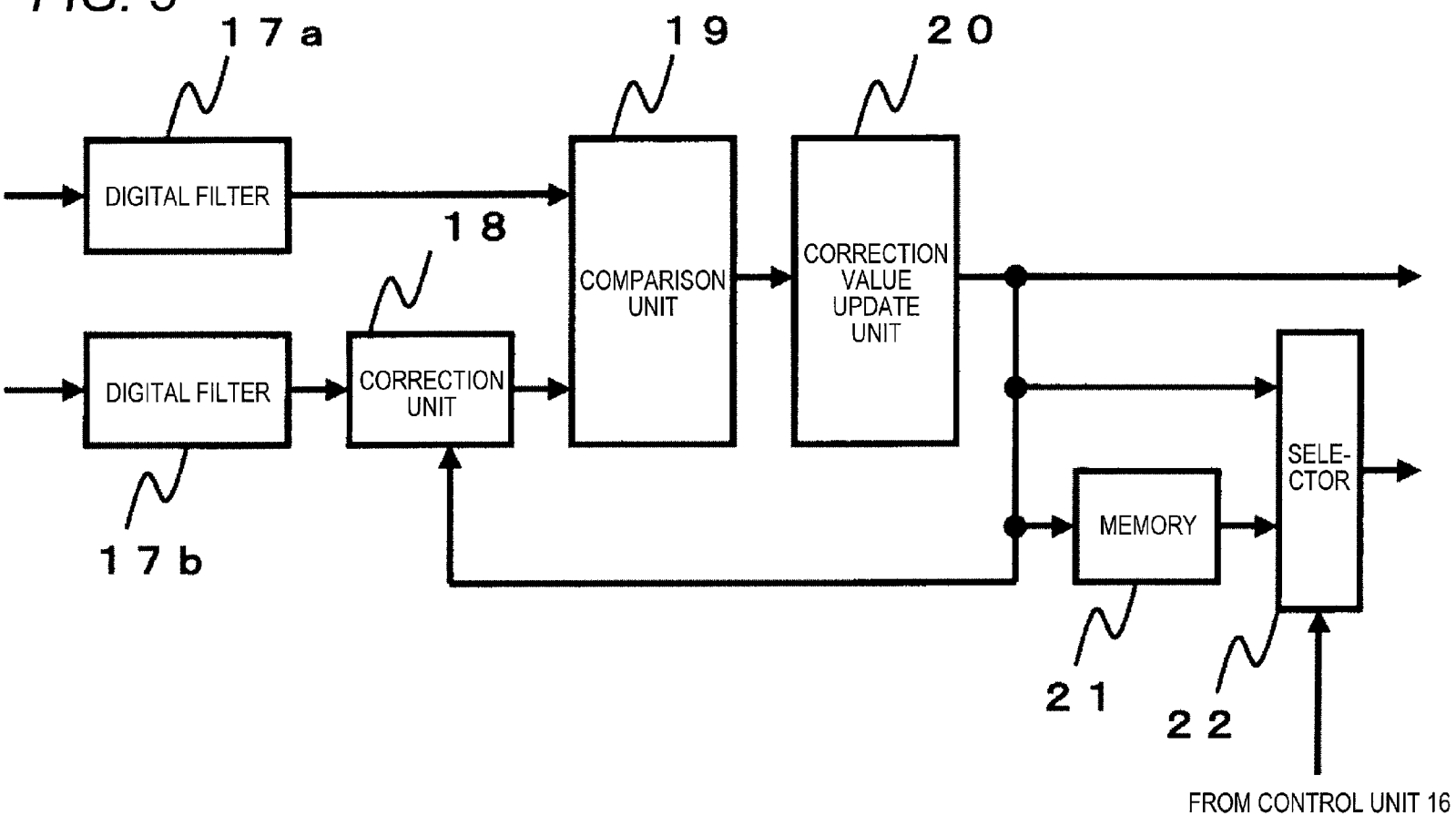
FIG. 3 is a block diagram of a microphone sensitivity correction value calculation unit.

As shown in FIG. 3, the microphone sensitivity correction value calculation unit 11 includes: a digital filter 17*a* (first digital filter) connected on an output side of the A/D converter 8*a*; a digital filter 17*b* (second digital filter) connected on an output side of the A/D converter 8*b*; a correction unit 18 connected on an output side of the digital filter 17*b*; a comparison unit 19 to which an output signal of the correction unit 18 and an output signal of the digital filter 17*a* are input; and a correction value update unit 20 connected on an output side of the comparison unit 19. The microphone sensitivity correction value calculation unit 11 further includes: a memory 21 connected on an output side of the correction value update unit 20; and a selector 22 to which an output signal of the memory 21 and an output signal of the correction value update unit 20 are input, and which is configured to select and output one of the signals input thereto.

Each of the digital filter 17*a* and the digital filter 17*b* includes a plurality of FIR (Finite Impulse Response) filters. One function is to smooth the amplitude of a digital input signal. Thus, a moving average of amplitude values continuous in time series of digital input signal is computed. Another function is to shut off high frequency to execute microphone sensitivity correction using a signal in a low frequency area where amplitude fluctuation of digital input signal is small.

The correction unit 18 corrects the amplitude value of an output signal of the digital filter 17*b* using the correction value output by the correction value update unit 20. Since the configuration is the same as that of the microphone sensitivity correction unit 9 described above, and the configuration is not be described again in detail.

The comparison unit 19 compares the amplitude value of the output signal of the digital filter 17*a* and the amplitude value of the output signal of the correction unit 18 and outputs the comparison result to the correction value update unit 20. The comparison is made every one clock of the operation clock. The comparison result indicates three states. Here, the comparison unit 19 outputs "2" if the amplitude value of the output signal of the digital filter 17*a* is larger; the comparison unit 19 outputs "1" if the amplitude value of the output signal of the correction unit 18 is larger; and the comparison unit 19 outputs "0" if both are the same.

The correction value update unit 20 generates the microphone sensitivity correction value to correct the amplitude of the input signal in the microphone sensitivity correction unit 9 and the correction unit 18 based on the input signal from the comparison unit 19. The microphone sensitivity correction value is a coefficient to be multiplied by the amplitude of a signal to make a correction. When the amplitude is not corrected, namely, the outputs of the front microphone and the rear microphone are the same, the microphone sensitivity correction value becomes 1.0. When the amplitude of the output signal of the front microphone is larger than the amplitude of the output signal of the rear microphone, the microphone sensitivity correction value becomes a numeric value exceeding 1 such as 1.1 to increase the amplitude of the output signal of the rear microphone. On the other hand, the amplitude of the output signal of the front microphone is smaller than the amplitude of the output signal of the rear microphone, the microphone sensitivity correction value becomes a numeric value smaller than 1 such as 0.9 to decrease the amplitude of the output signal of the rear microphone.

The microphone sensitivity correction value is updated as described below. First, a memory (not shown) is provided in the correction value update unit 20, and an initial value, an increment value, and a decrement value are stored in the memory. For example, the initial value is set to 1.0000 and the increment value and the decrement value are set to 0.0001. When the operation of the microphone sensitivity correction value calculation unit 11 is started, the initial value is set to the microphone sensitivity correction value. Then, every one clock of the operation clock, when the signal input from the comparison unit 19 is 2, the increment value is added to the microphone sensitivity correction value, and when the signal input from the comparison unit 19 is 1, the decrement value is subtracted from the microphone sensitivity correction value, and the result value is output as a new microphone sensitivity correction value. For example, when the microphone sensitivity correction value one operation clock before is 1.0001, if 1 is input from the comparison unit 19, the microphone sensitivity correction value output from the correction value update unit 20 at the current clock becomes 1.0001. If the microphone sensitivity difference is previously known and an appropriate microphone sensitivity correction value can be calculated, an appropriate value for correcting the sensitivity difference may be previously adopted as the initial value rather than 1.0001. The increment value and the decrement value may be different values.

The microphone sensitivity correction value output by the correction value update unit 20 is output to the storage unit 12 and the failure detection unit 13 and is also output to the memory 21 and the selector 22 provided in the microphone sensitivity correction value calculation unit 11. An output signal of the selector 22 is transmitted to the microphone sensitivity correction unit 9 as the microphone sensitivity correction value and the digital input signal output by the A/D converter 8*b* is multiplied by the value.

The operation of the memory 21 and the selector 22, namely, a determination method of the microphone sensitivity correction value for making a sensitivity correction will be described. A control signal (not shown in FIG. 3) is input to the memory 21 and the selector 22 from the control unit 16. The memory 21 performs the storage operation of the microphone sensitivity correction value output by the correction value update unit 20 and the output operation to the selector 22 in accordance with the control signal. The selector 22 selects one of the microphone sensitivity correction value output by the correction value update unit 20 and the output signal of the memory 21 in accordance with the control signal and outputs the selected value or signal to the microphone sensitivity correction unit 9 as the microphone sensitivity correction value.

If the microphone sensitivity correction unit 9 performs the sensitivity correction by using the microphone sensitivity correction value always updated when the hearing aid operates, the selector 22 selects and outputs the microphone sensitivity correction value output by the correction value update unit 20.

On the other hand, if the sensitivity correction is performed by fixedly using the microphone sensitivity correction value updated at a specific time, the selector 22 selects and outputs the output value of the memory 21. The specific time refers to the initial adjustment time at the factory shipment time, the time of the stationary state after a battery is inserted into the battery insertion port 6 and power of the hearing aid is turned on, or the user-specified time. Thus, the memory 21 stores the microphone sensitivity correction value output by the correction value update unit 20 at the time (clock) instructed by the control unit 16 and stores the value until a next command is received from the control unit 16. The memory continues to output the stored value to the selector 22. Further, the selector 22 selects the output value of the memory 21 and output the value as the microphone sensitivity correction value. Accordingly, the microphone sensitivity correction unit 9 performs sensitivity correction by using the microphone sensitivity correction value at the specific time as a fixed value.

In the hearing aid of this embodiment, two sensitivity correction determination methods described above are set as function modes of the hearing aid, and one of the two function modes is selected for use by switching the selector 22. If only one of the function modes is implemented as the function of the hearing aid, only the selector 22 may be removed or both the memory 21 and the selector 22 may be removed from the configuration shown in FIG. 3.

Referring again to FIG. 2, the storage unit 12 will be described. The storage unit 12 stores the output signal of the hearing assistance processing unit 10 and the output signal of the microphone sensitivity correction value calculation unit 11 in separate storage areas. The signal output from the hearing assistance processing unit 10 is, for example, a gain selected when the hearing assistance processing unit 10 performs hearing assistance processing or the like and is mainly an operation history of the hearing assistance processing unit 10. The operation history stored in the storage unit 12 is transferred to a device outside the hearing aid, such as a fitting device using an input/output interface (not shown). This operation is the same as that of the related hearing aid and therefore will not be described again in detail.

The output signal of the microphone sensitivity correction value calculation unit 11 input to the storage unit 12 is the microphone sensitivity correction value output by the correction value update unit 20 shown in FIG. 3. The storage unit 12 has a plurality of storage areas for storing the microphone sensitivity correction value and is configured to store the value in accordance with a control signal of the control unit 16 and output the stored microphone sensitivity correction value to the failure detection unit 13 in accordance with a control signal of the control unit 16.

Similar to the operation history, the microphone sensitivity correction value stored in the storage unit 12 is also transferred to a device outside the hearing aid, such as a fitting device using the input/output interface (not shown). Thus, the stored microphone sensitivity correction value can be read by a device such as the fitting device, and the past microphone state can be analyzed.

The timing at which the storage unit 12 stores the microphone sensitivity correction value will be described. The storage unit 12 stores the microphone sensitivity correction value first calculated when the hearing aid of the embodiment is manufactured. The first calculated microphone sensitivity correction value is the most recent value of the microphone sensitivity correction value updated at one specific time described above. If the hearing aid is set such that the microphone sensitivity correction unit 9 performs the sensitivity correction by using the microphone sensitivity correction value always updated during the operation of the hearing aid, the storage unit 12 stores the microphone sensitivity correction value after a predetermined time has elapsed since the start of using the hearing aid.

Second or subsequent storage of the microphone sensitivity correction value is executed, for example, every month, because the amplitudes of the output signals of the microphone 3*a* and the microphone 3*b* may vary due to aging. Change per time by the aging is very small as compared with amplitude decrease of the output signal at the failure of the microphone, which is to be solved by the application.

The storage unit 12 stores the first stored microphone sensitivity correction value and the second and subsequent stored microphone sensitivity correction values in separate storage areas. The first stored microphone sensitivity correction value is held without being overwritten with another value. The second or subsequent stored microphone sensitivity correction value may be overwritten every time or may be stored in a separate area every time together with the storage order information without being overwritten. The storage unit 12 outputs the first stored microphone sensitivity correction value and the second and subsequent stored microphone sensitivity correction values to the failure detection unit 13.

Figure 4:
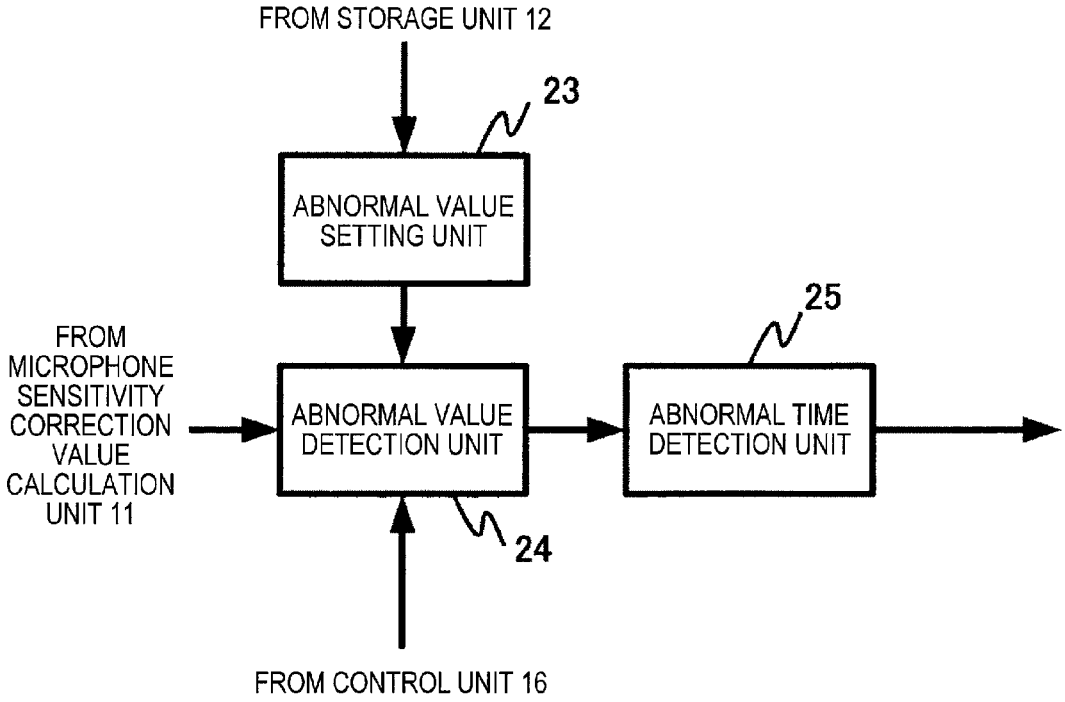
FIG. 4 is a block diagram of a failure detection unit.

As shown in FIG. 4, the failure detection unit 13 includes an abnormal value setting unit 23 connected on an output side of the storage unit 12, an abnormal value detection unit 24 to which an output signal of the abnormal value setting unit 23 and an output signal of the microphone sensitivity correction value calculation unit 11 are input, and an abnormal time detection unit 25 connected on an output side of the abnormal value detection unit 24.

The abnormal value setting unit 23 calculates a threshold value whether the microphone sensitivity correction value is an abnormal value by using an output signal of the storage unit 12, and outputs the threshold value to the abnormal value detection unit 24. First, the abnormal value setting unit 23 calculates a center value to set the threshold value from the signal input from the storage unit 12 as described below.

First, when the storage unit 12 has only the first stored microphone sensitivity correction value, namely, when the second or subsequent microphone sensitivity correction value is not yet stored, the first stored microphone sensitivity correction value is adopted as the center value.

On the other hand, when the storage unit 12 has the second or subsequent stored microphone sensitivity correction value, the second or subsequent stored microphone sensitivity correction value is used as candidates for the center value. If the storage unit 12 has a plurality of second and subsequent stored microphone sensitivity correction values, the most recent value or an average value of a plurality of values from the most recent value is used as the candidate for the center value. Thereafter, the candidate for the center value is compared with the first stored microphone sensitivity correction value. When the candidate for the center value is in the range of 0.7 times to 1.5 times the first stored microphone sensitivity correction value, the candidate for the center value is adopted as the center value; and when the candidate is not in the range, the first stored microphone sensitivity correction value is adopted as the center value.

The reason why the second or later microphone sensitivity correction value stored in the storage unit 12 is used as the candidate for the center value is because whether the microphone fails is determined based on performance of the microphone at the time point of failure detection considering the effect of aging. The purpose of comparing the candidate for the center value with the first stored microphone sensitivity correction value is to detect a failure even if the effect is caused by aging, when the microphone sensitivity correction value shifts in a predetermined range or more, that is, when the output difference between the front microphone and the rear microphone becomes larger than a predetermined range.

When the center value is thus determined, then the abnormal value setting unit 23 sets a threshold value TH_H and a threshold value TH_L. The threshold value TH_H is a threshold value on a higher side of the microphone sensitivity correction value, and the threshold value TH_L is a threshold value on a lower side of the microphone sensitivity correction value. The abnormal value setting unit 23 includes a memory (not shown) and stores an increment value and a decrement value in the memory. The threshold value TH_H is set as a value obtained by adding the increment value to the center value. The threshold value TH_L is set as a value obtained by subtracting the decrement value from the center value. The threshold value TH_H and the threshold value TH_L are output to the abnormal value detection unit 24. For example, when the increment value is 0.5000 and the decrement value is 0.3000, and when the center value is 1.0021, the threshold value TH_H becomes 1.5021 and the threshold value TH_L becomes 0.7021.

Next, the abnormal value detection unit 24 will be described. The microphone sensitivity correction value output by the microphone sensitivity correction value calculation unit 11, the threshold value TH_H and the threshold value TH_L output by the abnormal value setting unit 23, and the control signal output by the control unit 16 are input to the abnormal value detection unit 24. The abnormal value detection unit 24 outputs an abnormal value detection signal to the abnormal time detection unit 25 as the result of comparing the microphone sensitivity correction value and the threshold value TH_H and the threshold value TH_L. This comparison is made every clock of the operation clock. When the microphone sensitivity correction value is equal to or more than the threshold value TH_H or when the microphone sensitivity correction value is equal to or less than the threshold value TH_L, the abnormal value detection signal becomes 1; otherwise, the abnormal value detection signal becomes 0. If the control signal from the control unit 16 validates the comparison result, namely, control is performed so as not to execute failure detection in the failure detection unit 13, the abnormal value detection signal becomes 0 regardless of the microphone sensitivity correction value.

Figure 5A:
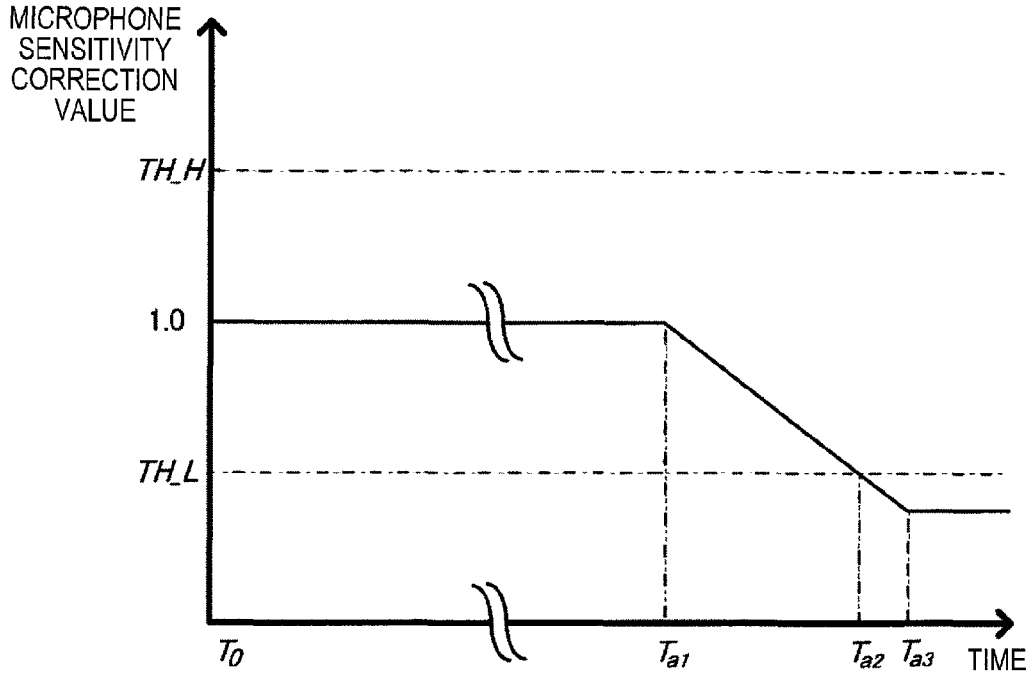
FIGS. 5A and 5B are schematic representations of the operation of an abnormal value detection unit.
Figure 5B:
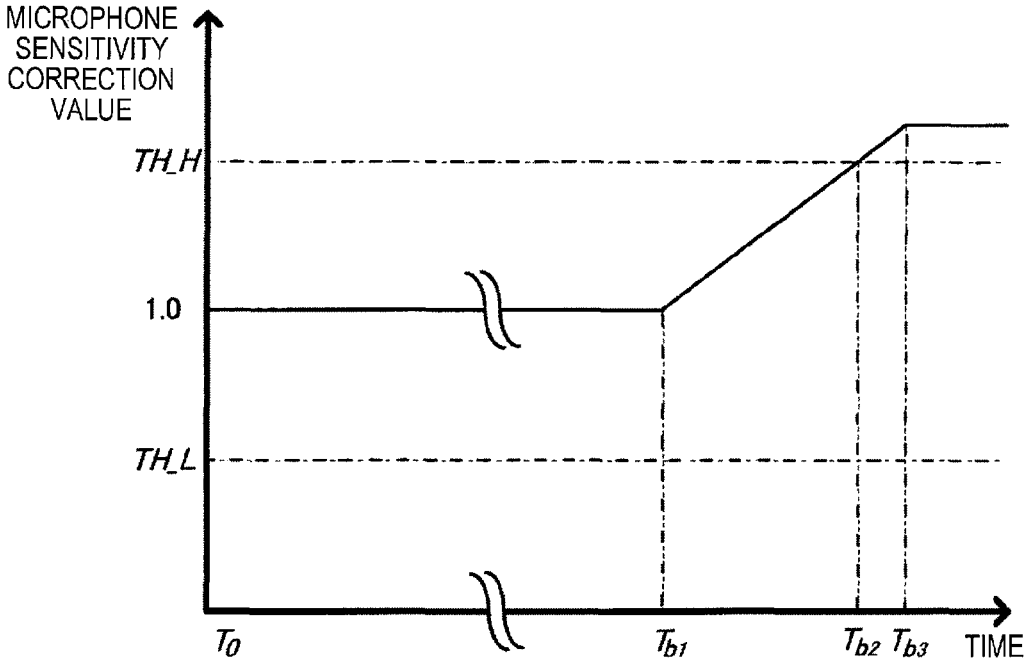

The operation of the abnormal value detection unit 24 will be described with reference to FIGS. 5A and 5B. FIGS. 5A and 5B show schematically an example of a time change in the microphone sensitivity correction value. In FIG. 5A, a failure occurs in the front microphone at time Ta1 and the amplitude of an output signal of the microphone 3*a* becomes small, and thus the microphone sensitivity correction value becomes gradually small so as to bring the amplitude of the output signal of the rear microphone close to that of the front microphone. At time Ta2, the microphone sensitivity correction value falls below the threshold value TH_L. At time Ta3, the amplitude value of the output signal of the digital filter 17*a* and the amplitude value of the output signal of the correction unit 18 become the same and the microphone sensitivity correction value is a constant value. At this case, the abnormal value detection signal becomes 0 from time T0 to Ta2 and becomes 1 after Ta2.

On the other hand, in FIG. 5B, a failure occurs in the rear microphone at time Tb1 and the amplitude of an output signal of the microphone 3*b* becomes small and thus the microphone sensitivity correction value becomes gradually large so as to bring the amplitude of the output signal of the rear microphone close to that of the front microphone. At time Tb2, the microphone sensitivity correction value exceeds the threshold value TH_H. At time Tb3, the amplitude value of the output signal of the digital filter 17*a* and the amplitude value of the output signal of the correction unit 18 become the same and the microphone sensitivity correction value is a constant value. At this case, the abnormal value detection signal becomes 0 from time T0 to Tb2 and becomes 1 after Tb2.

Next, the abnormal time detection unit 25 will be described. The abnormal value detection signal output by the abnormal value detection unit 24 is input to the abnormal time detection unit 25, and the abnormal time detection unit 25 determines whether a failure occurs in the microphone based on the abnormal value detection signal and outputs a failure detection signal to the sound output unit 14.

Thus, the abnormal time detection unit 25 includes a counter (not shown) for counting from 0 to the maximum count (C_max). When the abnormal value detection signal is 1, the counter is incremented by one; and when the abnormal value detection signal is 0, the counter is decremented by one. In a case where the abnormal value detection signal 0 is input when the value of the counter is 0, the value of the counter maintains 0. In a case where the abnormal value 1 is input when the value of the counter is C_max, the value of the counter maintains C_max.

When the value of the counter is equal to or more than a counter threshold value C_th set in the abnormal time detection unit 25, the abnormal time detection unit 25 determines that a failure occurs in the microphone 3*a* or the microphone 3*b*, and sets a failure detection signal to 1. On the other hand, when the value of the counter is smaller than the counter threshold value C_th, the abnormal time detection unit 25 determines that a failure does not occur in the microphone 3*a* or the microphone 3*b*, and sets the failure detection signal to 0 and outputs the signal to the sound output unit 14. The operation of the abnormal time detection unit 25 is executed every one clock of the operation clock.

As described above, when the failure detection unit 13 detects that a given time period has elapsed in a state in which the microphone sensitivity correction value output by the microphone sensitivity correction value calculation unit 11 becomes outside a specified range, the failure detection unit 13 determines that a failure occurs in the microphone.

Referring again to FIG. 2, the sound output unit 14 will be described. The sound output unit 14 receives a digital hearing assistance processing signal subjected to hearing assistance processing and output by the hearing assistance processing unit 10 and the failure detection signal output by the failure detection unit 13, determines a sound provided for the user as the hearing aid, and outputs the sound to the D/A converter 15.

Figure 6:
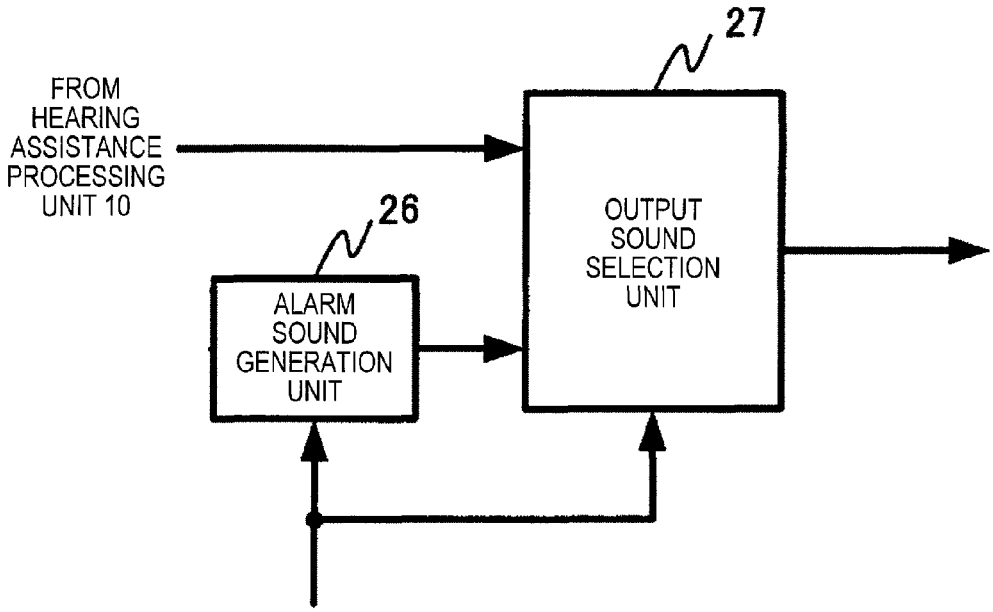
FIG. 6 is a block diagram of a sound output unit.

As shown in FIG. 6, the sound output unit 14 includes: an alarm sound generation unit 26 connected to the output of the failure detection unit 13; and an output sound selection unit 27 to which an output signal of the alarm sound generation unit 26 and an output signal of the hearing assistance processing unit 10 are input, and which is configured to select one of the output signal of the alarm sound generation unit 26 and the output signal of the hearing assistance processing unit 10 and to output the selected signal to the D/A converter 15.

The alarm sound generation unit 26 generates an alarm sound based on the failure detection signal output by the failure detection unit 13. More particularly, while the failure detection signal is 1, the alarm sound generation unit 26 generates an alarm sound and outputs it to the output sound selection unit 27; while the failure detection signal is 0, the alarm sound generation unit 26 does not generate an alarm sound. The alarm sound is a monotonous continuous sound such as a beep sound, and the sound volume and the frequency are matched with the hearing characteristic of the user used as the reference when the hearing assistance processing unit 10 performs hearing assistance processing and are set to the level at which the user hears most comfortable. The alarm sound may be music or a voice.

The output signal of the hearing assistance processing unit 10 and the output signal of the alarm sound generation unit 26 are input to the output sound selection unit 27. Based on the failure detection signal output by the failure detection unit 13, when the failure detection signal is 0, the output sound selection unit 27 selects the output signal of the hearing assistance processing unit 10; and when the failure detection signal is 1, the output sound selection unit 27 selects the output signal of the alarm sound generation unit 26 and outputs the selected signal to the D/A converter 15. That is, when the failure detection unit 13 determines that a failure does not occur in the microphone 3*a* or the microphone 3*b*, a sound subjected to hearing assistance processing is output; otherwise, an alarm sound is output.

The D/A converter 15 converts the digital signal output by the sound output unit 14 into an analog signal and outputs the analog signal to the receiver 7. This operation is performed by using the same operation clock as the A/D converter 8*a* and the A/D converter 8*b*.

The receiver 7 is a speaker for converting the analog signal output by the D/A converter 15 into an acoustic signal and outputting the acoustic signal.

The control unit 16 generates various control signals for controlling the microphone sensitivity correction value calculation unit 11, the storage unit 12, and the failure detection unit 13. The control unit 16 includes a memory storing an operation program of the hearing aid and a CPU (Central Processing Unit) for executing the program, and executes the program so as to generate various control signals at the timings described above. The control unit 16 controls the whole hearing aid including the function components shown in FIG. 2, but the operation for controlling other than the function components of the feature of the embodiment will not be described.

Figure 7A:
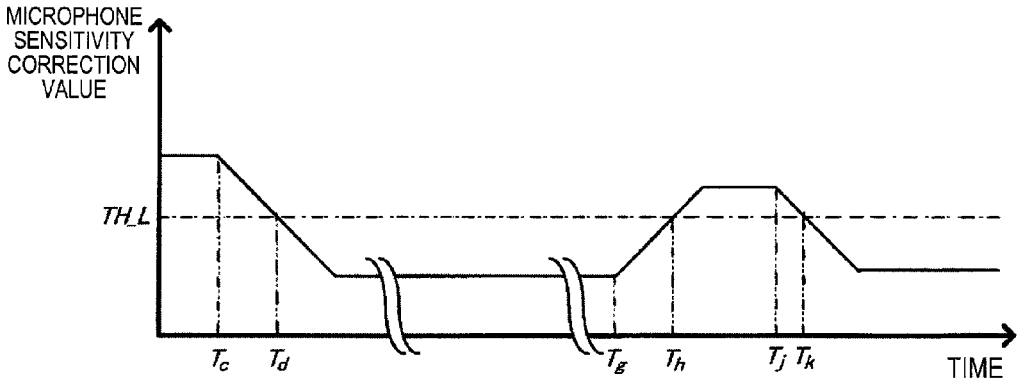
FIGS. 7A to 7C are operation diagrams of the hearing aid according to the embodiment of the invention.
Figure 7B:
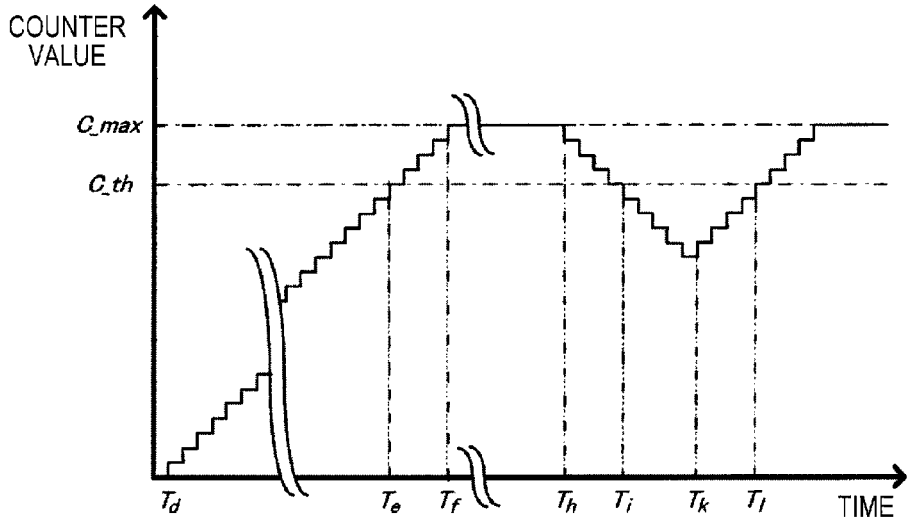
Figure 7C:
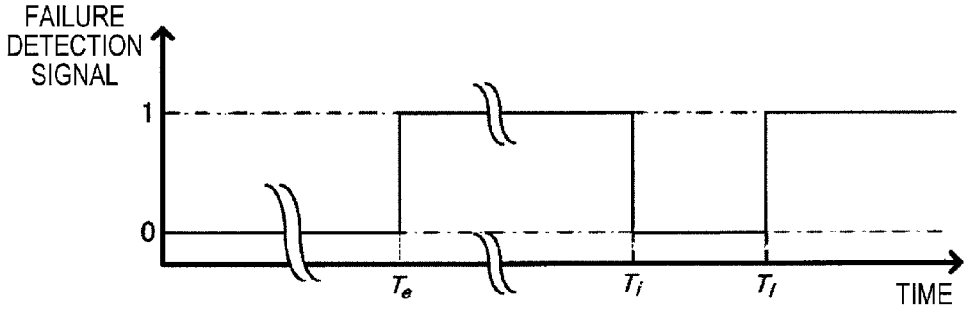

Next, an operation example of failure detection of the feature of the embodiment will be described with reference to FIGS. 7A to 7C. FIG. 7A shows the microphone sensitivity correction value output by the microphone sensitivity correction value calculation unit 11, FIG. 7B shows the value of the counter in the abnormal time detection unit 25 in the failure detection unit 13, and FIG. 7D shows the failure detection signal output by the failure detection unit 13. FIGS. 7A to 7C show the case where the front microphone (microphone 3*a*) fails at time Tc, and the amplitude of the output signal of the microphone 3*a* becomes drastically small.

When the amplitude of the output signal of the microphone 3*a* becomes small at the time Tc, the microphone sensitivity correction value starts to decrease such that the amplitude of the output signal of the rear microphone (microphone 3*b*) becomes the same as the amplitude of the output signal of the microphone 3*a*. When the microphone sensitivity correction value becomes equal to or less than the threshold value TH_L at time Td, the value of the counter starts to increase. Thereafter, the decrease in the microphone sensitivity correction value stops. However, since the microphone sensitivity correction value is smaller than the threshold value TH_L, the value of the counter continues to increase (from time Td to time Te).

When the value of the counter becomes equal to or more than the counter threshold value C_th at time Te, the failure detection signal changes from 0 to 1. At this time, output of an alarm sound is started from the receiver 7 and thus the user can recognize that one of the front microphone and the rear microphone fails. At this point in time, however, the user cannot determine which microphone fails. Then, the value of the counter still increases, and when the value reaches the maximum count C_max, the counter continues to hold the value.

Time Tg represents the time at which the user closes the rear microphone (microphone 3*b*) with a finger. At this time, while the amplitude of the output signal of the microphone 3*a* remains small, the amplitude of the output signal of the microphone 3*b* becomes small. Therefore, the microphone sensitivity correction value starts to increase. When the microphone sensitivity correction value becomes larger than the threshold value TH_L at time Th, the value of the counter starts to decrease from the maximum count value C_max.

When the value of the counter becomes smaller than the counter threshold value C_th at time Ti, the failure detection signal changes from 1 to 0. Then, the alarm sound output from the receiver 7 stops, and a sound subjected to hearing assistance processing is again output.

Time Tj is the time at which the user releases the finger which has closed the rear microphone. The amplitude of the output signal of the microphone 3*b* becomes large, and a difference from the amplitude of the output signal of the microphone 3*a* occurs. Consequently, the microphone sensitivity correction value again starts to decrease. At this time, the value of the counter still continues to decrease. At time Tk, the microphone sensitivity correction value becomes equal to or less than the threshold value TH_L, and change of the value of the counter transits from decrease to increase. At time TL, the value of the counter again becomes equal to or more than the counter threshold value T_th, and the sound output from the receiver 7 changes to an alarm sound.

Accordingly, the user can easily know that the microphone (rear microphone) closed with a finger normally operates, and the other microphone (front microphone) fails. On the other hand, if the front microphone fails as in the example described above, beeping of an alarm sound does not stop for a while after the user closes the front microphone with a finger at time Tg. At this time, the user can recognize that the microphone not closed with a finger (rear microphone) normally operates, and the user can estimate that the microphone closed with the finger (front microphone) fails.

If the rear microphone fails, similarity applies. That is, when the front microphone is closed with a finger, an alarm sound and a sound subjected to hearing assistance processing are switched and output in association with the operation, and the user can easily know that the microphone closed with the finger (front microphone) normally operates and the other microphone (rear microphone) fails.

The embodiment describes the example in which the user can recognize which of the two microphones fails by operation of the user. However, the receiver 7 may output an alarm sound so as to indicate which microphone fails.

Figure 8:
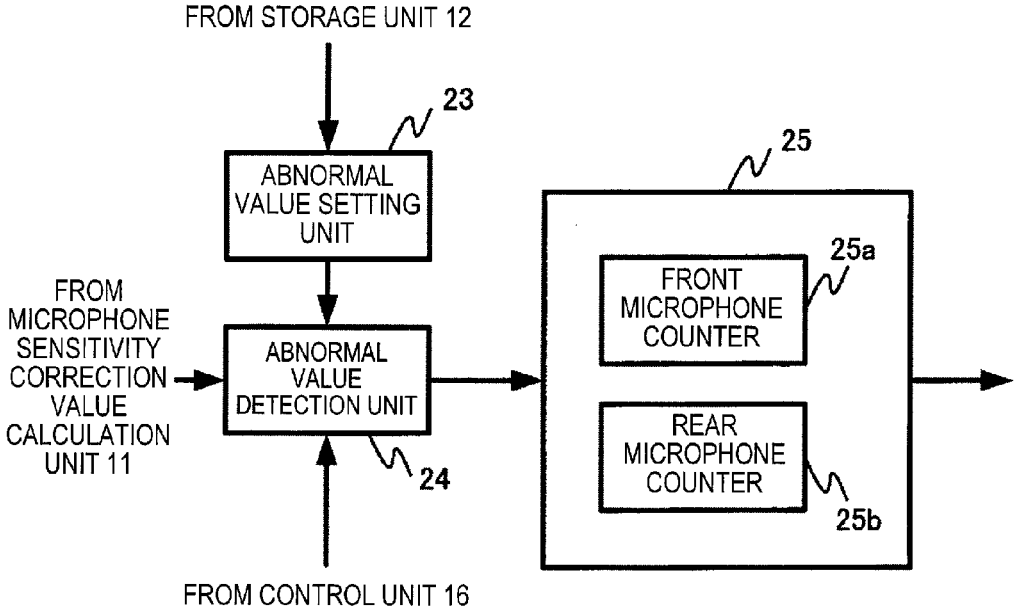
FIG. 8 is a block diagram to show another configuration of the failure detection unit.

FIG. 8 shows the configuration of the failure detection unit 13 for outputting the alarm sound. This configuration differs from the above-described configuration in that the abnormal time detection unit 25 includes a front microphone counter 25*a* (first counter) and a rear microphone counter 25*b* (second counter).

Further, the specification of the abnormal value detection signal output by the abnormal value detection unit 24 is changed. More particularly, when the microphone sensitivity correction value output by the microphone sensitivity correction value calculation unit 11 becomes equal to or more than the threshold value TH_H, the abnormal value detection signal indicates 2; when the microphone sensitivity correction value becomes equal to or less than the threshold value TH_L, the abnormal value detection signal indicates 1; and when the microphone sensitivity correction value is larger than the threshold value TH_L and is smaller than the threshold value TH_H, the abnormal value detection signal indicates 0.

When the abnormal value detection signal is 2, the abnormal time detection unit 25 increments the rear microphone counter 25*b* by one and decrements the front microphone counter 25*a* by one. When the abnormal value detection signal is 1, the abnormal time detection unit 25 increments the front microphone counter 25*a* by one and decrements the rear microphone counter 25*b* by one. Further, when the abnormal value detection signal is 0, the abnormal time detection unit 25 decrements both the front microphone counter 25*a* and the rear microphone counter 25*b* by one.

The specification of the failure detection signal output by the abnormal time detection unit 25 is also changed. More particularly, when the value of the rear microphone counter 25*b* becomes equal to or more than the counter threshold value C_th, the failure detection signal becomes 2; when the value of the front microphone counter 25*a* becomes equal to or more than the counter threshold value C_th, the failure detection signal becomes 1; and when both the value of the front microphone counter 25*a* and the value of the rear microphone counter 25*b* become smaller than the counter threshold value C_th, the failure detection signal becomes 0. That is, when the failure detection signal is 2, the rear microphone (microphone 3*b*) fails; when the failure detection signal is 1, the front microphone (microphone 3*a*) fails; and when the failure detection signal is 0, neither of the microphones fails.

Further, the operation of the sound output unit 14 is also changed. First, in the alarm sound generation unit 26, when the failure detection signal is 2, a continuous sound of a beep sound is generated. When the failure detection signal is 1, a sound such that a short sound of a beep sound is repeated at given intervals is generated. When the failure detection signal is 0, an alarm sound is not generated.

Next, when the failure detection signal is 2 or 1, the output sound selection unit 27 selects and outputs an alarm sound output by the alarm sound generation unit 26, and when the failure detection signal is 0, the output sound selection unit 27 selects and outputs an output signal of the hearing assistance processing unit 10.

Therefore, when the front microphone fails, an alarm sound of a short repetitive sound is output, and when the rear microphone fails, an alarm sound of a continuous sound is output. This means that the length of the output alarm sound is changed in response to the failing microphone. Accordingly, the user can easily know which of the two microphones fails.

The alarm sound generated by the alarm sound generation unit 26 may be music or a voice informing the user which microphone fails. At this time, the type of alarm sound, the type of music, the type of voice, etc., is changed in response to which microphone fails.

The embodiment discloses the example in which when the microphone fails, only an alarm sound is output from the receiver 7. However, an alarm sound may be combined with the sound subjected to hearing assistance processing by the hearing assistance processing unit 10, and the synthesized sound may be output.

Thus, the sound output unit 14 is provided with an output sound synthesis unit in place of the output sound selection unit 27. When the failure detection signal output by the failure detection unit 13 indicates a failure of the microphone, the output sound synthesis unit combines the alarm sound output by the alarm sound generation unit 26 with the output signal of the hearing assistance processing unit 10, and outputs the result to the D/A converter 15.

With this configuration, the user can recognize a failure of the microphone while hearing the surrounding sound, and can continue to use the hearing aid until the failure of the microphone is repaired.

As described above, the hearing aid in the embodiment includes: the first microphone; the first A/D converter connected on the output side of the first microphone; the second microphone; the second A/D converter connected on the output side of the second microphone; the microphone sensitivity correction unit connected on the output side of the second A/D converter; the hearing assistance processing unit to which the output of the microphone sensitivity correction unit and the output of the first A/D converter are input; the microphone sensitivity correction value calculation unit to which the output of the first A/D converter and the output of the second A/D converter are input, and one output of which is connected to the microphone sensitivity correction unit; the storage unit connected to another output of the microphone sensitivity correction value calculation unit; the failure detection unit to which the output of the storage unit and a signal output from the another output of the microphone sensitivity correction value calculation unit are input; the sound output unit to which an output signal of the failure detection unit and an output signal of the hearing assistance processing unit are input; the D/A converter connected on the output side of the sound output unit; and the receiver connected on the output side of the D/A converter. Accordingly, the user can recognize a failure of the microphone.

Further, according to the embodiment, when one microphone fails, the user can easily recognize which of the microphones fails by simple operation of the user or without operation of the user.

According to the embodiment, the microphone sensitivity correction value is stored in the storage unit 12, whereby it is possible to later determine when an anomaly has occurred by reading the storage unit 12.

In the embodiment, the failure detection unit 13 includes the abnormal time detection unit 25, but the abnormal time detection unit 25 may be eliminated. At the time, the abnormal value detection signal output by the abnormal value detection unit 24 is adopted as an output signal from the failure detection unit 13 to the sound output unit 14.

In the embodiment, the in-the-ear hearing aid is illustrated in FIG. 1, but a hearing aid of any other type such as a behind-the-ear hearing aid or an pocket hearing aid may be applied so long as the hearing aid uses two microphones.

While the invention has been described in detail with reference to the specific embodiments, it is apparent to those skilled in the art that various changes and modifications may be made without departing from the spirit and the scope of the invention.

This application is based on Japanese Patent Application No. 2009-025743 filed on Feb. 6, 2009, contents of which are incorporated herein by reference.

According to the embodiment, the user can recognize a failure of the microphone. Further, the microphone sensitivity correction value is stored, whereby it is possible to determine when an anomaly has occurred by reading the storage unit. When a failure of the microphone is detected by using the microphone sensitivity correction value, sound indicating the failure of the microphone is generated, whereby the user can recognize the failure of the microphone by hearing the sound.

The hearing aid according to the embodiment can make the user recognize failure of the microphone and can be widely applied to hearing aid devices.

DESCRIPTION OF REFERENCE SIGNS

1 Face plate
2 Shell
3*a*, 3*b* Microphone
4 Switch
5 Volume dial
6 Battery insertion port
7 Receiver
8*a*, 8*b* A/D converter
9 Microphone sensitivity correction unit
10 Hearing assistance processing unit
11 Microphone sensitivity correction value calculation unit
12 Storage unit
13 Failure detection unit
14 Sound output unit
15 D/A converter
16 Control unit
17*a*, 17*b* Digital filter
18 Correction unit
19 Comparison unit
20 Correction value update unit
21 Memory
22 Selector
23 Abnormal value setting unit
24 Abnormal value detection unit
25 Abnormal time detection unit
25*a* Front microphone counter
25*b* Rear microphone counter
26 Alarm sound generation unit
27 Output sound selection unit

What is claimed is:

1. A hearing aid comprising:
a first microphone;
a first A/D converter connected on an output side of the first microphone;
a second microphone;
a second A/D converter connected on an output side of the second microphone;
a microphone sensitivity correction unit connected on an output side of the second A/D converter;
a hearing assistance processing unit to which an output of the microphone sensitivity correction unit and an output of the first A/D converter are input;
a microphone sensitivity correction value calculation unit to which the output of the first A/D converter and an output of the second A/D converter are input, and one output of which is connected to the microphone sensitivity correction unit;
a storage unit connected to another output of the microphone sensitivity correction value calculation unit;
a failure detection unit to which an output of the storage unit and a signal output from the another output of the microphone sensitivity correction value calculation unit are input;
a sound output unit to which an output signal of the failure detection unit and an output signal of the hearing assistance processing unit are input;
a D/A converter connected on an output side of the sound output unit; and
a receiver connected on an output side of the D/A converter,
wherein the microphone sensitivity correction value calculation unit comprises:
a first digital filter connected on an output side of the first A/D converter;
a second digital filter connected on the output side of the second A/D converter;
a correction unit connected on an output side of the second digital filter;
a comparison unit to which an output signal of the correction unit and an output signal of the first digital filter are input; and
a correction value update unit connected on an output side of the comparison unit.

2. The hearing aid according to claim 1,
wherein the microphone sensitivity correction value calculation unit comprises:
a memory connected on an output side of the correction value update unit; and
a selector to which an output signal of the memory and an output signal of the correction value update unit are input, and which is configured to select one of the signals.

3. A hearing aid comprising:
a first microphone;
a first A/D converter connected on an output side of the first microphone;
a second microphone;

a second A/D converter connected on an output side of the second microphone;

a microphone sensitivity correction unit connected on an output side of the second A/D converter;

a hearing assistance processing unit to which an output of the microphone sensitivity correction unit and an output of the first A/D converter are input;

a microphone sensitivity correction value calculation unit to which the output of the first A/D converter and an output of the second A/D converter are input, and one output of which is connected to the microphone sensitivity correction unit;

a storage unit connected to another output of the microphone sensitivity correction value calculation unit;

a failure detection unit to which an output of the storage unit and a signal output from the another output of the microphone sensitivity correction value calculation unit are input;

a sound output unit to which an output signal of the failure detection unit and an output signal of the hearing assistance processing unit are input;

a D/A converter connected on an output side of the sound output unit; and a receiver connected on an output side of the D/A converter wherein the failure detection unit comprises:

an abnormal value setting unit connected on an output side of the storage unit;

an abnormal value detection unit to which an output signal of the abnormal value setting unit and an output signal of the microphone sensitivity correction value calculation unit are input; and an abnormal time detection unit connected on an output side of the abnormal value detection unit wherein the abnormal time detection unit comprises:

a first counter used for determining a failure of the first microphone; and a second counter used for determining a failure of the second microphone.

4. The hearing aid according to claim 3, wherein the sound output unit changes a length of an alarm sound, which is to be output, based on information of the first counter and the second counter.

5. The hearing aid according to claim 3, wherein the sound output unit changes a type of an alarm sound, which is to be output, based on information of the first counter and the second counter.

6. The hearing aid according to claim 1, wherein the storage unit stores a microphone sensitivity correction value calculated by the microphone sensitivity correction value calculation unit.

* * * * *